United States Patent [19]

Temple

[11] 4,001,534

[45] Jan. 4, 1977

[54] SWITCH ASSEMBLIES

[76] Inventor: James E. Temple, 24 Spruce Ave., Bethpage, N.Y. 11714

[22] Filed: June 27, 1975

[21] Appl. No.: 591,156

[52] U.S. Cl. ..... 200/160; 200/276

[51] Int. Cl.[2] ..... H01H 13/52

[58] Field of Search ..... 200/160, 159 R, 238, 200/239, 276, 275, 284, 5 A, 16 D, 16 R

[56] References Cited

UNITED STATES PATENTS 3,610,857 10/1971 Nanninga ..... 200/160

*Primary Examiner*—Herman J. Hohauser

*Attorney, Agent, or Firm*—Steinberg & Blake

[57] ABSTRACT

A switch assembly which has a pair of electrically non-conductive sheets which are maintained spaced from each other by a suitable spacer structure. One sheet is formed with an opening passing therethrough and the spacer structure is clear of this opening so that the sheets have inner surface regions directed toward each other with one of these surface regions surrounding the opening and the other surface region being directed toward the opening. A switch-operating structure is freely movable through this opening and is electrically conductive. This switch-operating structure has between the sheets an inner enlarged electrically conductive head end which has a thickness less than the space between the sheets so that this inner head end is movable between the inner surface regions of the sheets. The switch-operating structure has an outer enlarged electrically conductive head end situated at the exterior of the sheet which is formed with the opening, at the side of the latter opposite from the other sheet. A spring surrounds the switch-operating structure and engages the one sheet as well as the outer enlarged head end of the switch-operating structure so as to urge the inner enlarged head end thereof toward the inner surface region which surrounds the opening through which the switch-operating structure extends. The outer surface of the sheet which is formed with the opening carries an electrically conductive coating which engages the spring which is itself electrically conductive, and one of the above inner surface regions also carries an electrically conductive coating to be engaged by the inner enlarged electrically conductive head end of the switch-operating structure. In this way when the latter structure is displaced with respect to the opening toward the sheet which does not have the opening therein, an electrical circuit which includes the electrically conductive coatings will have its condition changed.

11 Claims, 7 Drawing Figures

SWITCH ASSEMBLIES

BACKGROUND OF THE INVENTION

The present invention relates to switching structures.

As is well known, there are many electrically controlled circuits which require a relatively large number of switches, commonly known as keyboards. These switches may be normally closed, normally open, or they may be switches designed when operated to open one electrical circuit and close another electrical circuit. Where relatively large numbers of such switches are required, particularly where they must be grouped together at a single central location such as at a suitable console where control of relatively involved circuitry is to be carried out, it is exceedingly difficult on the one hand to group the relatively large number of switches together in a relatively small space and on the other hand to provide a relatively simple inexpensive structure which will reliably provide the desired controls in a convenient manner.

At the present time known assemblies of switches of this type require a relatively large number of elements of complex construction to be assembled together so that on the one hand the cost of the conventional structure is undesirably high, on the other hand an undesirably large space is occupied thereby, and in addition the weight of the structure is undesirably great and the complex components give rise to faulty operation which require fairly extensive maintenance operations to be performed. In addition, the conventional structure requires such a large space that it cannot always be accomodated in a given available space without resorting to special costly constructions.

SUMMARY OF THE INVENTION

It is accordingly a primary object of the present invention to provide a construction which will avoid the above drawbacks.

In particular, it is an object of the present invention to provide a switch assembly which has relatively simple inexpensive components assembled together in such a way that an extremely reliable and convenient operation is assured.

Moreover, it is an object of the present invention to provide a structure of the above type which will occupy only a relatively small space even though a large number of switches are included in this small space.

Furthermore it is an object of the present invention to provide a structure of this type which can be very conveniently operated either automatically or manually.

In addition it is an object of the present invention to provide a structure of the above type which is exceedingly simple, being composed of a relatively small number of simple inexpensive components which can be readily assembled together in any desired arrangement to provide any desired combination of different types of switches according to the requirements of particular circuitry.

In accordance with the invention the electrical switch structure includes a pair of electrically non-conductive sheets and an electrically non-conductive spacer means situated between and engaging the sheets to maintain them apart from each other with the inner surfaces of the sheets respectively directed toward each other. One of the sheets is formed with an opening passing therethrough and the spacer means is clear of an inner surface region of this one sheet which surrounds the opening thereof as well as an inner surface region of the other sheet which is directed toward the opening of the one sheet. An elongated electrically conductive switch-operating means extends freely through the opening of the one sheet so as to be movable with respect to this one sheet, the switch-operating means having an outer electrically conductive enlarged head end larger than the opening and situated at the side of the one sheet opposite from the other sheet. The switch-operating means also has an inner electrically conductive enlarged head end situated between the sheets and also being larger than the opening, this inner head end having a thickness smaller than the space between the sheets so as to be movable in this space between the sheets. An electrically conductive spring means surrounds the elongated switch-operating means and extends between the one sheet and the outer enlarged head end of the switch-operating means to urge the inner enlarged head end thereof toward the inner surface region of the one sheet which surrounds the opening thereof. A pair of electrically conductive coatings form part of an electrical circuit, one of these coatings being carried by an outer surface of the one sheet in engagement with the electrically conductive spring means while the other of these coatings is carried by one of the inner surface regions of the sheet to be engaged by the inner enlarged head end of the switch-operating means. In this way when the switch-operating means is moved in opposition to the spring means to displace its inner enlarged head end away from the one sheet toward the other sheet, it is possible to change the relationship between the inner enlarged head end of the switch-operating means and this other coating so as to change the condition of a circuit of which the coatings form a part.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
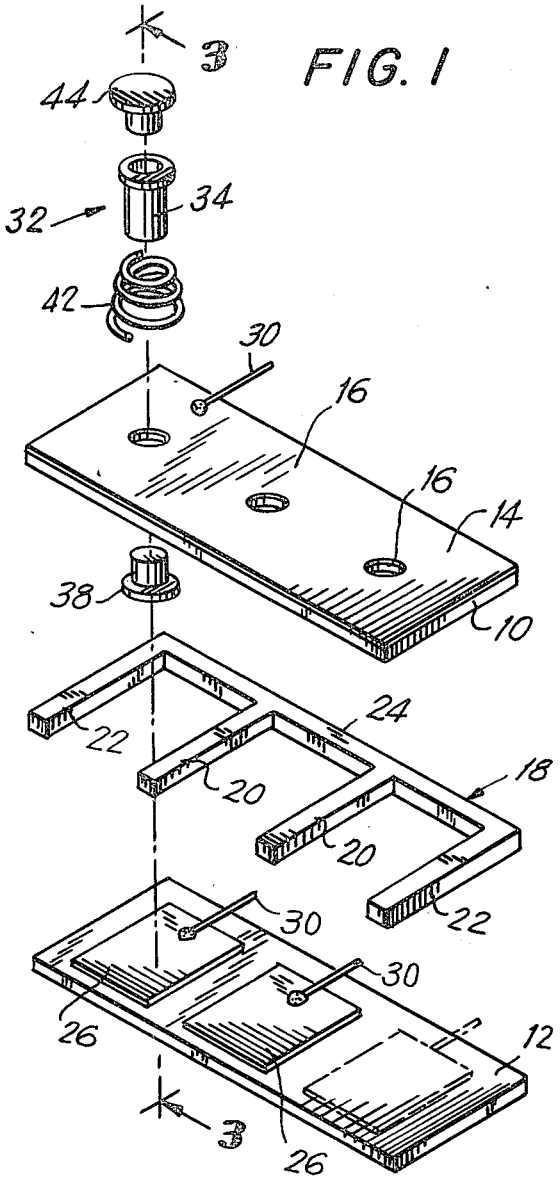
FIG. 1 is an exploded perspective illustration of part of a switch structure according to the invention.

Referring to FIG. 1, the switch structure illustrated therein includes a pair of sheers 10 and 12 which are of an electrically non-conductive material. Thus, these sheets 10 and 12 can be made of any suitable plastic such as, for example, polyvinylchloride and they can be relatively thin, having a thickness, for example on the order of substancially less than a ¼ inch. Although the electrically non-conductive sheets are shown as being made of plastic, they can also be made of other electrically non-conductive material such as heavy cardboard, for example, of even thin layers of wood.

The upper sheet 10 of FIG. 1 is covered at its upper outer surface by an electrically conductive coating 14 which may be in the form of a thin layer of copper of the like. This coating 14 can be joined to the outer surface of the sheet 10 in any suitable way such as by being vapor-deposited thereon so that an extremely thin layer or coating is provided in this way. Moreover, the sheet 10 together with the coating 14 thereon are formed with openings 16 passing therethrough for a purpose referred to below.

A spacer means 18 is situated between and engages the sheets 10 and 12 at inner surfaces thereof which are directed toward each other. This spacer means 18 is in the form of a bar structure as illustrated. The elongated bar portions 20 will be situated between and spaced from the openings 16 while the bar portions 22 and 24 will extend along edge regions of the sheets. In this way the spacer means 18, which is also made of an electrically non-conductive material such as a suitable plastic, is capable of maintaining the sheets 10 and 12 spaced from each other while inner surface regions of the sheets at the vicinity of the openings 16 are not engaged by the spacer means 18 which is thus clear of these inner surface regions of the sheets. Thus the sheet 10 will have inner surface regions clear of the spacer means 18 and surrounding the openings 16 while the sheer 12 will have inner surface regions also clear of the spacer means 18 and directed toward the openings 16.

Figure 5:
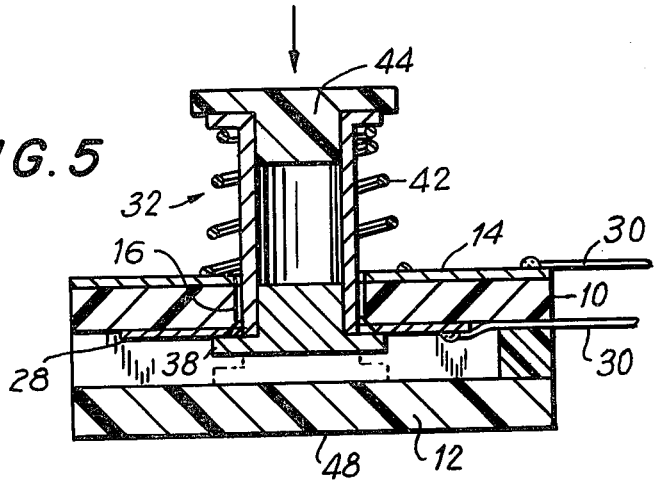
FIG. 5 is a sectional illustration of the structure of the invention which will provide a switch structure as shown in FIG. 4.
Figure 7:
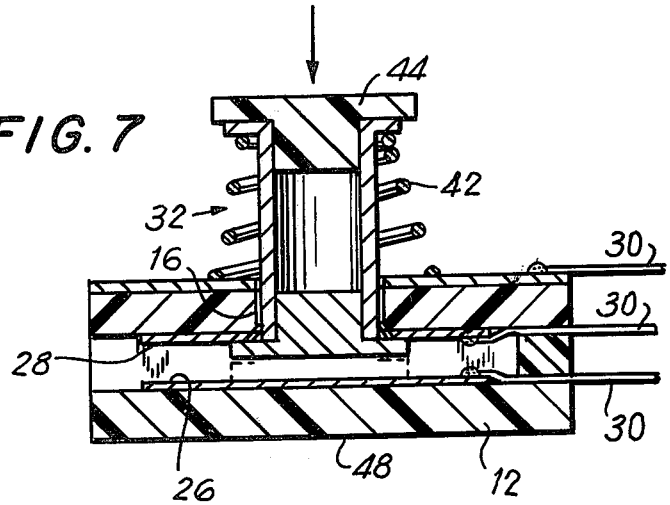
FIG. 7 is a sectional illustration of a switch structure according to the invention which will achieve an operation as shown in FIG. 6.

One or more of these inner surface regions of the sheet 12 may be provided with electrically conductive coatings 26, and one or more of the inner surface regions of the sheet 10 surrounding the openings 16 thereof may also be provided with electrically conductive coatings 28 which are illustrated in FIGS. 5 and 7. For this purpose the inner surfaces of the sheets 10 and 12 can initially be covered with a copper coating which may be vapor deposited on these inner surfaces, and then the coating can be etched away at the regions where the spacer means 18 will be located so that in this way separate coating portions 26 are provided at the inner surface regions of sheet 12 which are respectively directed toward one or more of the openings 16, and in the same way separate coating areas 28 may be provided at the inner surface regions of the sheet 10 which respectively surround the openings 16 thereof. Suitable conductors 30 are respectively connected with the several coatings as by being soldered or otherwise joined thereto, so that in this way the several coatings will form part of given electrical circuits.

Figure 3:
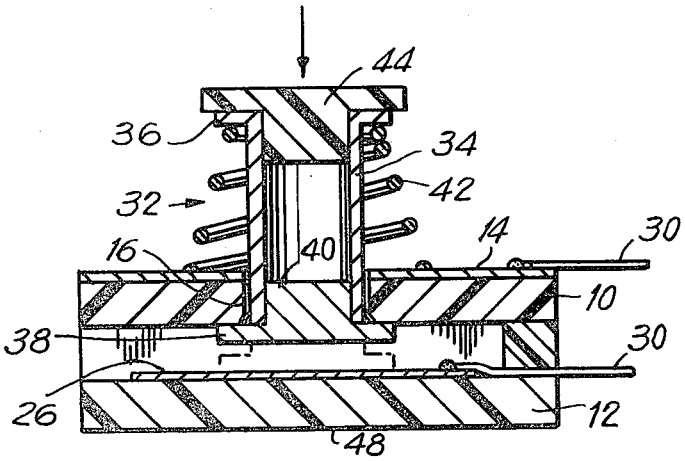
FIG. 3 is a sectional view of the structure of FIG. 1 taken along line 3—3 of FIG. 1 in the direction of the arrows, showing the parts in an assembled condition for achieving an operation as shown schematically in FIG. 2.

A switch-operating means 32 extends through each opening 16. This switch-operating means 32 has an elongated electrically conductive tubular portion 34 small enough to pass freely through the opening 16. This element 34 may be in the form of a relatively small tubular rivet made of any electrically conductive metal. Outwardly of the sheet 10 the switch-operating means 32 has an enlarged head end 36 which is electrically conductive and larger than the opening 16, this enlarged head end 36 being formed by an outwardly directed flange at the outer open end of the tube 34. Opposite to the enlarged outer head end 36 the switch-operating means 32 has an enlarged electrically conductive inner head end 38 formed by a flange which also has a diameter larger than the opening 16 and which extends outwardly from an insert 40 which can be pressed with a tight press fit into the interior of the lower open end of the tube 34, as illustrated in FIGS. 1 and 3. The tight press fit of the electrically conductive insert 40 in the tube 34 assures that these components will remain reliably connected to each other.

The electrically conductive spring means 42 surrounds the portion of the switch-operating means which extends upwardly beyond the coating 14 at the exterior of the sheet 10. This spring means 42 is in the form of a tapered coil spring having its small end in engagement with the outer enlarged head end 36 of the switch-operating means 32 and its large end directly in engagement with the electrically conductive coating 14. In order to improve the electrical connection with the coating 14 the largest convolution may be flattened so as to have a flat surface in engagement with the coating 14. For this purpose the small tapered coil spring 42 can be momentarily touched against a suitable grinding stone so as to have a flat end surface to lie flush against the coating 14 to provide a superior electrical connection thereto.

An electrically non-conductive button 44 may be inserted with a press fit into the outer open end of the tube 34, having also an enlarged flange engaging the flange 36, so that such a button 44 is available for manual operation although automatic operation can also be provided by way of any suitable cams or the like, for example.

In order to assemble the above structure the non-conductive buttons 44 may be initially joined with the outer flanged ends of the rivets or tubes 34. After the electrically conductive coatings have been provided in a desired arrangement on the sheets 10 and 12 the tube 34 is passed through a spring 42 and then through an opening 16, and then the insert 40 is applied with a press fit into the tube 34 at its end distant from the flange 36. Prior to this assembly operation it is possible to touch the inner surface of the sheet 10 at each opening 16 with a small countersinking tool which will provide a slight bevel at the inner end of dach opening 16 at the inner surface of the sheet 10, and in this way if a coating such as a coating 28 is carried by the sheet 10 at an inner surface region surrounding an opening 16 thereof, this coating 28 cannot engage the element 34.

Once the above components have been assembled with the sheet 10, the spacer means 18 is situated between and joined to the sheets 10 and 12. For this purpose any suitable adhesive such as a suitable epoxy resin may be used, or simple rivets or other fasteners may extend through the sheets and the spacer means to hold them assembled together.

Of course, conductors 30 which engage coatings 26 and 28 at the inner surface regions of the sheets can pass between the spacer means and the sheets in a manner shown in FIGS. 3, 5, and 7, and may take the form of extensions of the container itself.

Conductors 30 which engage coatings 26 and 28 at the inner surface regions of the sheets are shown at approximate locations. Individual design of multiple switch arrangements allow for use of standard printed circuit edge connectors to controlled circuits, or flexible type ribbon cable with suitable plug connectors or direct soldered connections to such circuits could be used at each required switch coating location.

Figure 2:
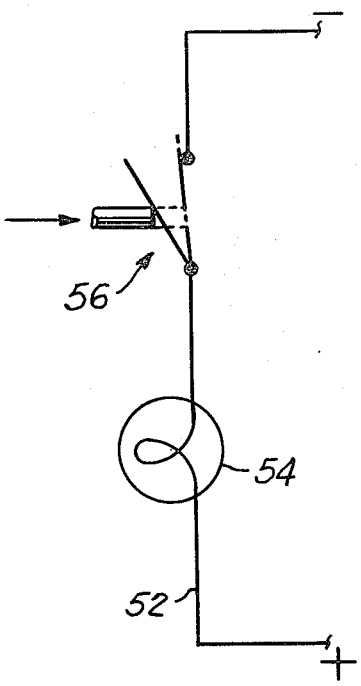
FIG. 2 is a schematic illustration of a circuit which may include the switch structure of the invention.

Various different types of switches can be provided with the above structure. For example as shown in FIGS. 2 and 3, the circuit 52 may include a lamp 54 or any other electrical unit which is to be energized. The switch 56 is a normally open switch adapted to be closed in order to energize the lamp or other unit 54. For this purpose the structure may be arranged as shown in FIG. 3. Thus while the outer surface of sheet 10 carries the coating 14 as described above, the inner surface of the sheet 10 does not have a coating surrounding the opening 16 of FIG. 3 and instead only the inner surface region of the sheet 12 has a coating 26 directed toward the opening 16 of FIG. 3. The conductors 30 of FIG. 3 are connected into a circuit as shown in FIG. 2. Thus, the spring means 42 of FIG. 3 normally maintains the switch shown in FIG. 3 in its open solid-line position. When the switch-operating means 32 is depressed in opposition to the spring 42 through a sufficient distance, the inner enlarged head end 38 will assume the dot-dash line position shown in FIG. 3 engaging the conductive coating 26. Now the circuit will be completed between the coatings 14 and 26 by way of the conductive head end 38, the electrically conductive tube 34, and the spring 42, so that the switch will be closed in order to be utilized for a purpose such as illuminating a lamp 54 as indicated in FIG. 2.

Figure 4:
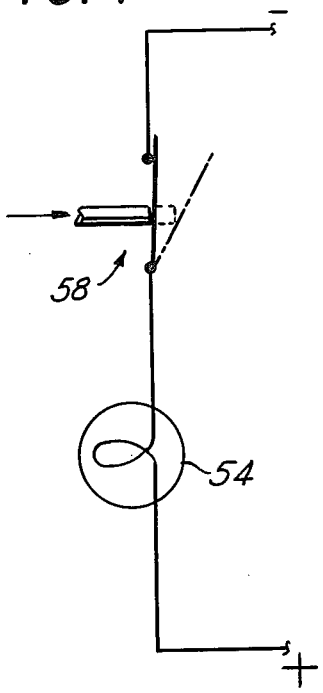
FIG. 4 is a schematic illustration of a different type of switch structure.

With an arrangement as shown in FIGS. 4 and 5, however, the switch forms a normally closed switch 58 for normally maintaining a lamp 54 or other electrical unit energized. Thus in this case the sheet 12 does not have a conductive coating directed toward the opening 16 shown in FIG. 5. Instead there is only an electrically conductive coating 28 at the inner surface region of the sheet 10 which surrounds the opening 16 thereof. Thus the spring means 42 of FIG. 5 normally maintains the switch-operating means 32 in the illustrated position where the circuit is completed between the coatings 14 and 28 so as to maintain a unit such as the lamp 54 of FIG. 4 in an energized condition. Now when the switch-operating means 32 is displaced toward the sheet 12 either manually or automatically the inner enlarged head end 38 will be displaced away from the coating 28 so as to open the switch and thus deenergize a unit such as the unit 54 of FIG. 4.

Figure 6:
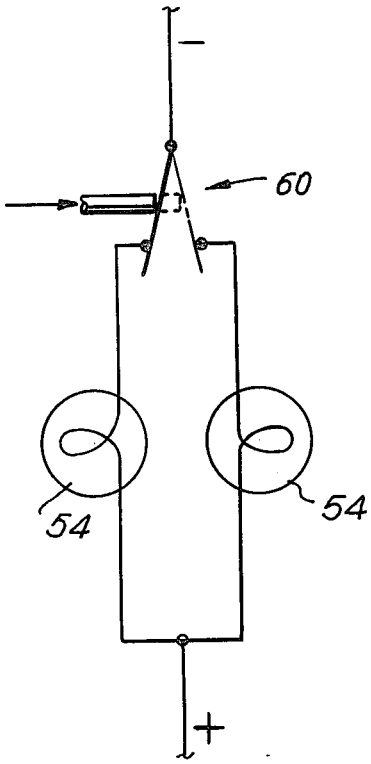
FIG. 6 is a schematic illustration of a further type of switch structure.

According to the arrangement shown in FIGS. 6 and 7, the features of FIGS. 3 and 5 are combined inasmuch as coatings 26 and 28 are provided at both inner surface regions, so as to provide a switch 60 capable of being operated for opening one circuit and closing another circuit. In this case also lamps 54 are indicated only by way of example as electrical units which can be respectively deenergized and energized in response to operation of the switch structure. Thus with this embodiment when the switch-operating means 32 is depressed between the solid and dot-dash line positions indicated in FIG. 7, one of the units 54 will become unenergized while the other will be energized, and upon release of the switch-operating means the spring means 42 will return the parts to the initial position where the first unit 54 again becomes energized and the other becomes unenergized.

As is apparent from the above, the structure of the invention is highly flexible since it can be adapted to be different types of switching structures referred to above. At the same time it is composed of simple inexpensive elements which are readily assembled so that the cost of the structure is extremely low.

Furthermore, it is to be emphasized that the structure is shown at an enlarged scale in the drawings. Actually the structure is quite small and compact. For example the sheets 10 and 12 need have a thickness which is no greater than 1/16 of an inch while the space between the sheets also need be no greater than 1/16 of an inch. This space actually can be somewhat less since the only requirement for this space is that it be great enough for the extremely thin inner enlarged head end of the switch-operating means to be able to move away from one sheet into engagement with another sheet while at the same time being movable into or out of engagement with an extremely thin coating. Depending upon the length of the tubular rivet elements 34, it is possible for the total height of the assembly, including the switch-operating means 32 to be as small as ⅜ of an inch, and no difficulty at all is encountered in maintaining the total height or depth of the entire assembly on the order of ½ inch or less. The area required for the coatings 26 or 28 is extremely small. Thus each coating 26 or 28 can be of a size no greater than ¼ inch square. The diameters of the opening 16 of course are substantially less, and the tubular rivets 34 have also an extremely small diameter. Thus the inner diameter of these rivets need be no greater than 1/16 inch while the outer diameter of the flange 36 which forms the outer head end of the switch-operating means need be no greater than ⅜ inch. Thus, there is no problem in grouping together a plurality of the above switches in such a way that between 25 and 50 of these switches are located in an area of a square whose length on each side need be no greater than 3 inches, in a unit where the switches are to be manually operated. The number can be greatly increased for a given area if the unit is automatically operated. Moreover, using the dual make-break switches of FIGS. 6 and 7 effectively doubles the number of circuits which are controlled.

The bottom surface of the lower sheet 12 forms a means for surface-mounting a unit of the invention and can be joined by any suitable epoxy or tape to the top surface of a suitable cabinet, console, or the like. Because of the extremely small total depth which can be achieved for the structure of the invention, it can be surface-mounted in many cases where conventional situations would require openings in a housing and special fittings to permit the structures to extend at least partly into a cabinet or housing. Also, by way of edge connectors, as commonly used in printed circuits, it is possible very easily to connect the various interior conductive areas 26 and 28 into a circuit in a simple effective manner.

In the event that the several switches are to be manually operated then the non-conductive button inserts 44 can be coded in any desired manner such as by being provided with different colors, symbols, letters, numerals or any combinations thereof.

What is claimed is:

1. An electrical switch structure comprising a pair of electrically non-conductive sheets and an electrically non-conductive spacer means situated between and engaging said sheets to maintain them apart from each other with inner surfaces of said sheets respectively directed toward each other, one of said sheets being formed with an opening passing therethrough and said spacer means being clear of an inner surface region of said one sheet which surrounds said opening thereof as well as an inner surface region of the other sheet which is directed toward said opening of said one sheet, an elongated electrically conductive switch-operating means extending freely through said opening of said one sheet so as to be movable with respect to said one sheet and having inner and outer, electrically conductive enlarged head ends larger than said opening and respectively situated at opposite sides of said one sheet, and said inner electrically conductive enlarged head end being situated between said sheets, said inner head end having a thickness smaller than the space between said sheets so as to be movable in said space between said sheets, electrically conductive spring means surrounding said elongated switch-operating means and extending between said one sheet and said outer enlarged head end of said switch-operating means for urging said inner enlarged head end thereof toward said inner surface region of said one sheet which surrounds said opening thereof, and a pair of electrically conductive coatings forming part of an electrical circuit, one of said coatings being carried by an outer surface of said one sheet in engagement with said electrically conductive spring means and the other of said coatings being carried by one of said inner surface regions of said sheets to be engaged by said inner enlarged head end of said switch-operating means, whereby said switch-operating means may be moved in opposition to said spring means to displace said inner enlarged head end away from said one sheet toward said other sheet to change the relationship between said inner enlarged head end of said switch-operating means and said other coating so as to change the condition of a circuit of which said coatings form a part.

2. The combination of claim 1 and wherein said other coating is carried by said inner surface region of said one sheet and is normally engaged by said inner enlarged head end of said switch-operating means so that a normally closed switch is provided and is adapted to be opened upon displacement of said switch-operating means toward said other sheet.

3. The combination of claim 1 and wherein said other coating is carried by said inner surface region of said other sheet in the path of movement of said inner enlarged head end of said switch-operating means toward said other sheet so that a normally open switch is provided and is adapted to be closed upon movement of said switch-operating means to an extent sufficient to place said inner enlarged head end of said switch-operating means in engagement with said other coating.

4. The combination of claim 1 and wherein a third electrically conductive coating which forms part of a predetermined electrical circuit is carried by the other of said inner surface regions so that while said spring means remains in engagement with said coating at the outer surface of said one sheet said inner enlarged head end of said switch-operating means will be displaced from one electrically conductive coating into engagement with another electrically conductive coating when said switch-operating means is moved toward said other sheet in opposition to said spring means, whereby said inner enlarged head end forms a movable switch member capable of opening one switch enclosing another switch when said switch-operating means is displaced in opposition to said spring means.

5. The combination of claim 1 and wherein said elongated switch-operating means includes an elongated hollow tube extending through said opening and having at an outer end an outwardly directed flange forming said enlarged outer head end of said switch-operating means and engaging one end of said spring means, an electrically conductive insert being fixed to said tube at its end distant from said flange thereof and said insert having between said sheets an enlarged outwardly directed flange larger than said opening and forming the inner head end of said switch-operating means.

6. The combination of claim 5 and wherein said spring means is in the form of a coil spring which at one end engages said flange of said tube and at its other end engages said coating at the outer surface of said one sheet.

7. The combination of claim 6 and wherein said spring is of a tapered configuration and has a large end engaging said coating at said outer surface of said one sheet and a small end engaging said flange which forms said enlarged outer head end of said switch-operating means.

8. The combination of claim 1 and wherein said one sheet is formed with a plurality of said openings and a plurality of said switch-operating means respectively extend through said openings while said sheets have at each of said openings of said one sheet said inner surface regions forming a pair of said inner surface regions for each switch-operating means, and said other coating being carried by at least one of each of said pair of inner surface regions for engagement with said inner enlarged head end of each switch-operating means, said spacer means being clear of all of said inner surface regions of said sheets.

9. The combination of claim 8 and wherein said spacer means includes a plurality of elongated bar portions situated between and spaced from said openings of said one sheet.

10. The combination of claim 1 and wherein said elongated switch-operating means includes an elongated hollow tube having an outer open end carrying an outwardly directed flange which forms said enlarged outer head end of said switch-operating means, and an electrically nonconductive button inserted into said open end of said tube and fixed thereto so as to be accessible for manual displacement of said switch-operating means.

11. The combination of claim 1 and wherein said other sheet has an outer surface directed away from said one sheet and forming a means for surface mounting the structure on any surface.

* * * * *